US005250985A

United States Patent [19]

Ishii et al.

[11] Patent Number: 5,250,985

[45] Date of Patent: Oct. 5, 1993

[54] IMAGE FORMING APPARATUS EQUIPPED WITH A BINDING FUNCTION

[75] Inventors: Yoshifumi Ishii, Daito; Naruyuki Miyamoto, Sakai, both of Japan

[73] Assignee: Mita Industrial Co., Ltd., Osaka, Japan

[21] Appl. No.: 780,331

[22] Filed: Oct. 22, 1991

[30] Foreign Application Priority Data

Oct. 29, 1990 [JP] Japan ..... 2-292773
Oct. 29, 1990 [JP] Japan ..... 2-292774

[51] Int. Cl.[5] ..... G03G 15/00; G03G 21/00

[52] U.S. Cl. ..... 355/206; 355/324; 340/640; 412/11; 412/33

[58] Field of Search ..... 355/205, 206, 209, 324; 412/11-13, 33, 37, 900; 340/640

[56] References Cited

U.S. PATENT DOCUMENTS 3,793,016 2/1974 Eichorn ..... 355/324 X
4,194,832 3/1980 Tabayashi .
4,566,782 1/1986 Britt et al. .
4,678,386 7/1987 Wiholm ..... 412/8
4,818,168 4/1989 Battisti ..... 412/37
4,848,797 7/1989 Vercillo et al. ..... 281/21.1
4,855,573 8/1989 Vercillo et al. ..... 219/492
4,901,994 2/1990 Ishiguro et al. ..... 270/53
4,985,729 1/1991 Sampath et al. ..... 355/206

FOREIGN PATENT DOCUMENTS 0334261 9/1989 European Pat. Off. .
0173509 3/5986 European Pat. Off. .
2641771 7/1990 France .
61-41261[U] 3/1986 Japan .
61-121456[U] 7/1986 Japan .

*Primary Examiner*—Joan H. Pendegrass
*Attorney, Agent, or Firm*—Beveridge, DeGrandi, Weilacher & Young

[57] ABSTRACT

An image forming apparatus equipped with a binding function includes an image forming unit for forming an image onto a sheet, a binding unit provided adjacent to the image forming unit, and a malfunction detector for detecting malfunction in the operation of the binding unit. The binding unit is provided with a binding condition display, and the image forming unit is provided with an alphanumeric character display and a device for instructing the start of an image forming operation. A detected malfunction is indicated by at least one of these displays. Upon detection of a malfunction by the malfunction detector, operation of the binding unit stops, or the entire operation of the apparatus stops.

16 Claims, 10 Drawing Sheets

IMAGE FORMING APPARATUS EQUIPPED WITH A BINDING FUNCTION

CROSS-REFERENCE TO RELATED APPLICATION

The present invention is related to the copending U.S. application Ser. No. 583,643, filed on Sep. 17, 1990, commonly assigned with the present application.

BACKGROUND OF THE INVENTION

The present invention relates generally to an image forming apparatus, and particularly to an image forming apparatus having a binding function.

Japanese Utility Model Laying-Open No. 41261/1986 discloses a copying machine provided with a binding device adjacent to the heating rollers of its fixing unit. In this copying machine, discharged sheets of paper are bound by utilizing the heat generated from the fixing unit.

Japanese Utility Model Laying-Open No. 121456/1986 discloses another copying machine with a binding device incorporated in a sorter provided adjacent to the copying machine body. In this copying machine, copy-processed sheets discharged from the body are received and bound by the binding device.

Such conventional image forming apparatuses having a binding function do not have any means of handling malfunctions which might occur during operation of the binding device.

In such conventional apparatus, an operator cannot satisfactorily observe the binding condition of the binding device. Particularly, it is unlikely he can discover any malfunction in the operation of the binding device.

SUMMARY OF THE INVENTION

One object of the present invention is to enable an imageforming apparatus equipped of a binding means to respond to malfunctions which may arise during the operation of the binding means.

Another object is to facilitate the detection of operational malfunctions in the binding means of an image forming apparatus capable of performing a binding function.

(1) An image forming apparatus according to an aspect of the present invention includes a unit for forming an image onto a sheet of paper, a binding unit adjacent to the image forming unit, a malfunction detector for detecting malfunction in the binding unit, and a total operation shutoff for interrupting the entire operation of the apparatus in response to the detection of a malfunction by the malfunction detector.

In this apparatus, the image forming unit forms an image onto a sheet, and the binding unit is employed to bind sheets. The malfunction detector detects any malfunction which may occur in the binding unit. In response to such a detection, the total operation shutoff interrupts the entire operation of the apparatus.

(2) An image forming apparatus according to another aspect of the present invention includes a unit for forming an image onto a sheet, a binding unit adjacent to the image forming unit, a malfunction detector for detecting malfunction in the binding unit, and a binding operation shutoff for interrupting the operation of the binding unit in response to the detection of a malfunction by the malfunction detector.

In this apparatus, the image forming unit forms an image onto a sheet, and the binding unit is employed to bind sheets. The malfunction detector detects any malfunction which may occur in the binding unit. In response to such a detection, the binding operation shutoff interrupts the operation of the binding unit wherein the trouble occurred.

(3) An image forming apparatus according to a further aspect of the present invention includes a unit for forming an image onto a sheet, a binding unit adjacent to the image forming unit, and a malfunction indicator for indicating a malfunction in the operation of the binding unit.

In this apparatus, the image forming unit forms an image onto a sheet, and the binding unit is employed to bind sheets. The malfunction indicator indicates the presence of any malfunction which may occur in the binding unit. As a result, the operator is made readily aware of a malfunction in the binding unit.

These and other objects and advantages of the present invention will be more fully apparent from the following detailed description.

DESCRIPTION OF THE PREFERRED EMBODIMENT

Figure 2:
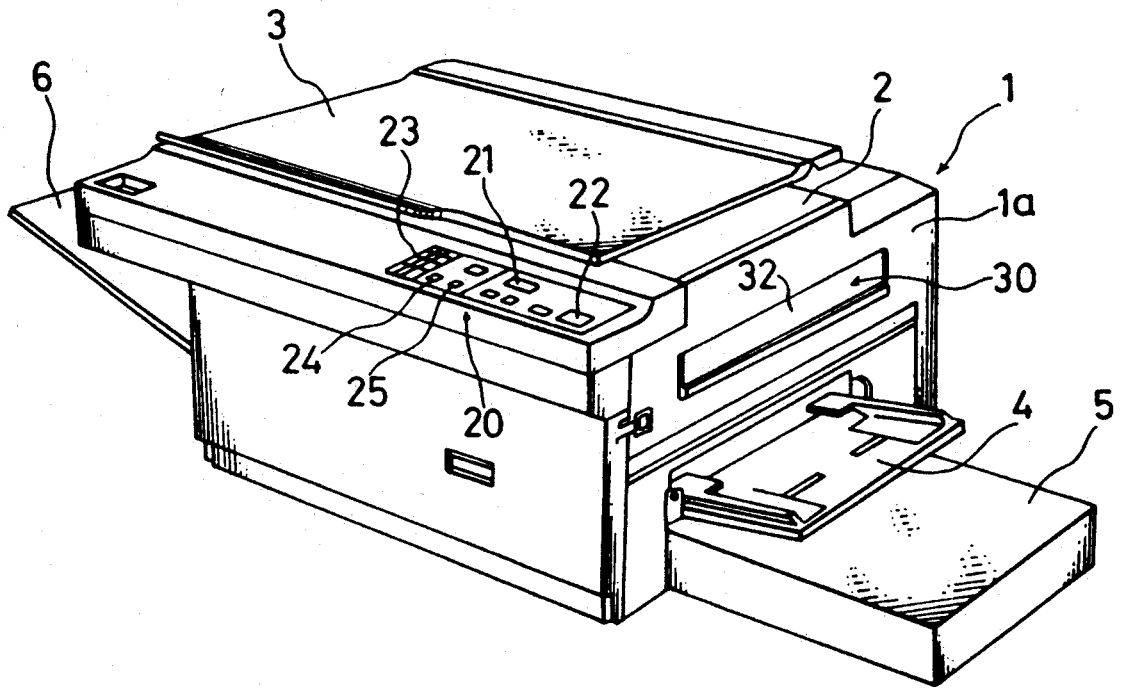
FIG. 2 is a perspective view of the apparatus.
Figure 3:
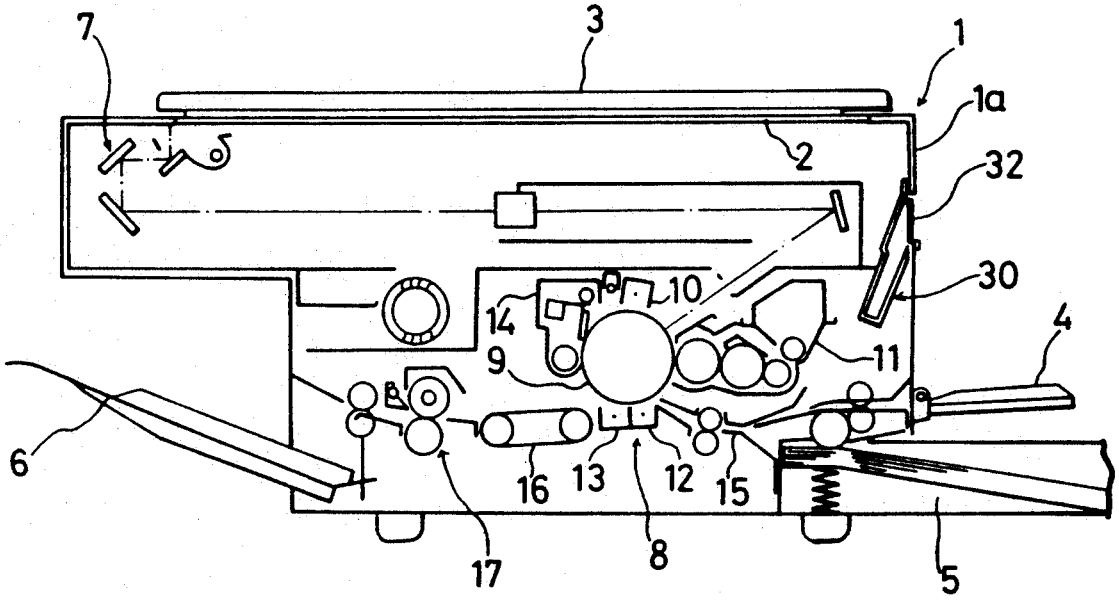
FIG. 3 is a schematic sectional view of the apparatus.

FIGS. 2 and 3 show a copying machine according to an embodiment of the present invention.

Referring to these figures, a copying machine body 1 includes an original support 2 in its upper surface, and an original cover 3 is openably disposed on the original support 2. On the right of the body 1 in the figures, a feed tray 4 and a feed cassette 5 are detachably mounted. On the left of the body 1, a copy tray 6 is disposed into which copy-processed sheets are discharged.

An optical exposure system 7 for reading an original is provided in an upper portion of the interior of the copying machine body 1. This optical exposure system 7 includes a light source and mirrors. An image forming unit 8 is provided in a central portion of the copying machine body 1. A photoconductive drum 9 on which an electrostatic latent image is formed is disposed at the center of the image forming unit 8. A main charger 10, a developing unit 11, a transfer charger 12, a separation charger 13, a cleaning unit 14 and related elements are disposed surrounding the photoconductive drum 9. A sheet transporting path 15 including a plurality of transport rollers extends from the feed tray 4 and feed cassette 5 to the image forming unit 8. A sheet discharging system 16 and a fixing unit 17 are provided between the image forming unit 8 and the copy tray 6.

Figure 1:
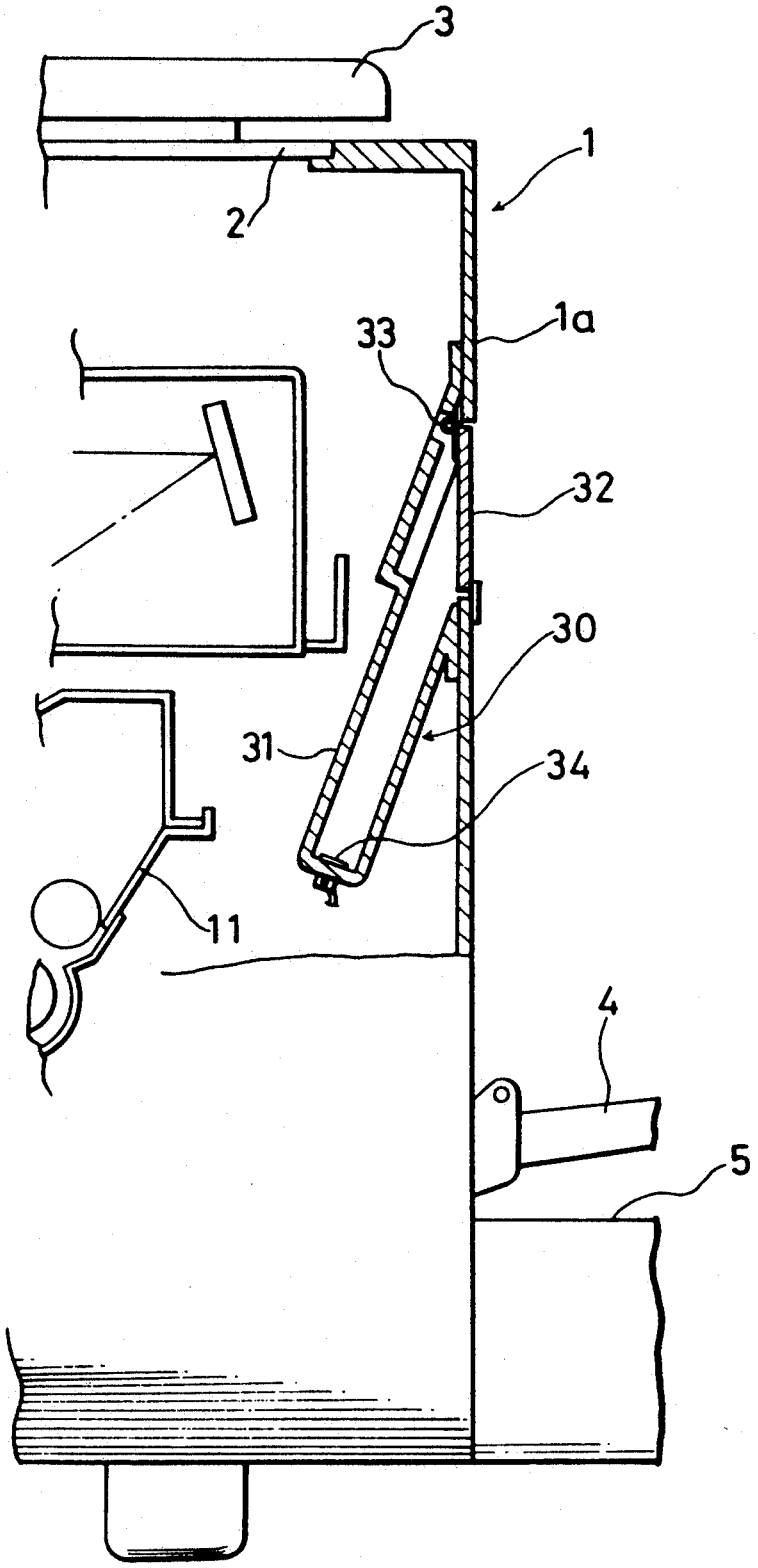
FIG. 1 is a partly in sectional view of an image forming apparatus according to an embodiment of the present invention.

A binding unit 30 is provided in a right upper portion interiorly of the body 1, adjacent to the image forming unit 8. Referring now to FIG. 1, the binding unit 30 includes a container 31 which opens in a side wall 1*a* of the body 1 and extends obliquely downward from the side wall 1*a*. The opening of the container 31 is shut by a cover 32. The cover 32 is openable on a hinge 33 along its upper end. A pair of electrodes 34 for supplying electric power to a binder cover (described afterwards) is provided on the inner bottom surface of the container 31.

Figure 5:
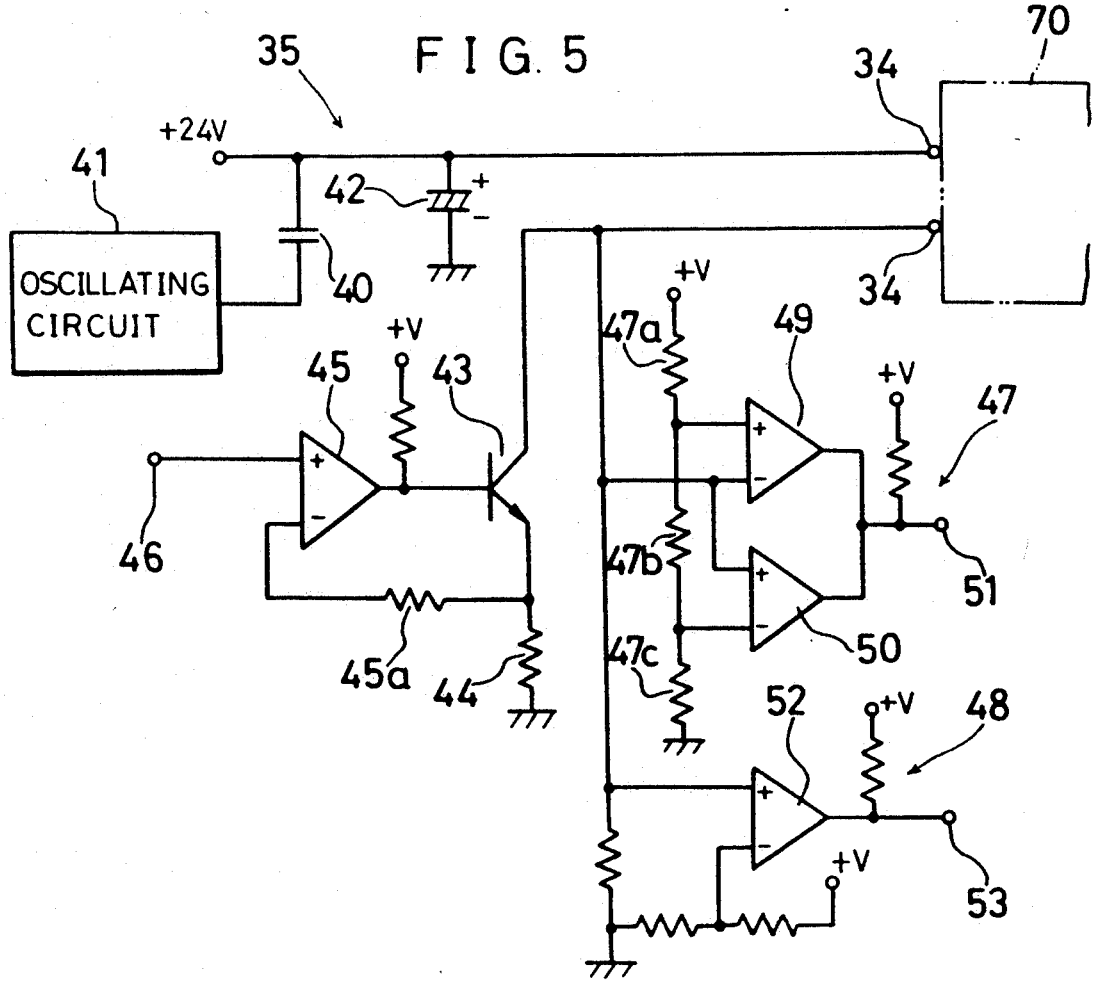
FIG. 5 is a circuit diagram of a binding unit of the apparatus.

A control circuit 35, shown in FIG. 5 controls the binding unit 30. Referring to FIG. 5, a +24 V power source is connected to one of the two electrodes 34. An oscillating circuit 41 is connected between the +24 V power supply and the electrode 34 through a capacitor 40. A storage capacitor 42 for storing electric charge is also connected therebetween.

The collector of a power transistor 43 is connected to the other of the two electrodes 34. The emitter of the power transistor 43 is grounded through a resistor 44. The base of the power transistor 43 is connected to the output terminal of a comparator 45. The non-inverting terminal of the comparator 45 is connected to a remote terminal 46. The inverting terminal of the comparator 45 is connected with the emitter of the power transistor 43 through a resistor 45*a*.

A malfunction detecting circuit 47 and a start detection circuit 48 are provided between the power transistor 43 and the latter of the two electrodes 34. The trouble detecting circuit 47 includes a pair of comparators 49 and 50, and generates a high level output at an NG terminal 51 only when the collector voltage of the power transistor 43 is within a prescribed normal range. This normal range is defined by values of voltages applied to the input terminals of the comparators 49 and 50. The voltage values are fixed by voltage-dividing resistors 47*a*, 47*b* and 47*c*. The malfunction detecting circuit 47 generates a low level output upon detection of any malfunction in a binding operation, such as an abnormal value of the resistance of the electric heater in a binder cover (described afterwards), or a defect in the electrical contact made with the electrodes 34. The start detecting circuit 48 includes a comparator 52, and generates a high level output at a start terminal 53 upon detection of an increase in the collector voltage of the power transistor 43.

As shown in FIG. 2, an operation panel 20 is provided on the right front corner of the upper surface of the copying machine body 1. The operation panel 20 includes a liquid crystal display (LCD) 21 for displaying operation conditions, such as the number of copies and the operation time, in alphanumeric characters. The operation panel 20 further includes a print key 22 for instructing copy start, a ten-key board 23 for designating the number of copies, a heating-state lamp 24 for indicating a heating state of the binding unit 30, and a cooling-state lamp 25 for indicating a cooling state thereof. The print key 22 contains an LED which is illuminated when the copy operation is enabled. The lamps 24 and 25 each contain both a blue LED and a red LED.

Figure 4:
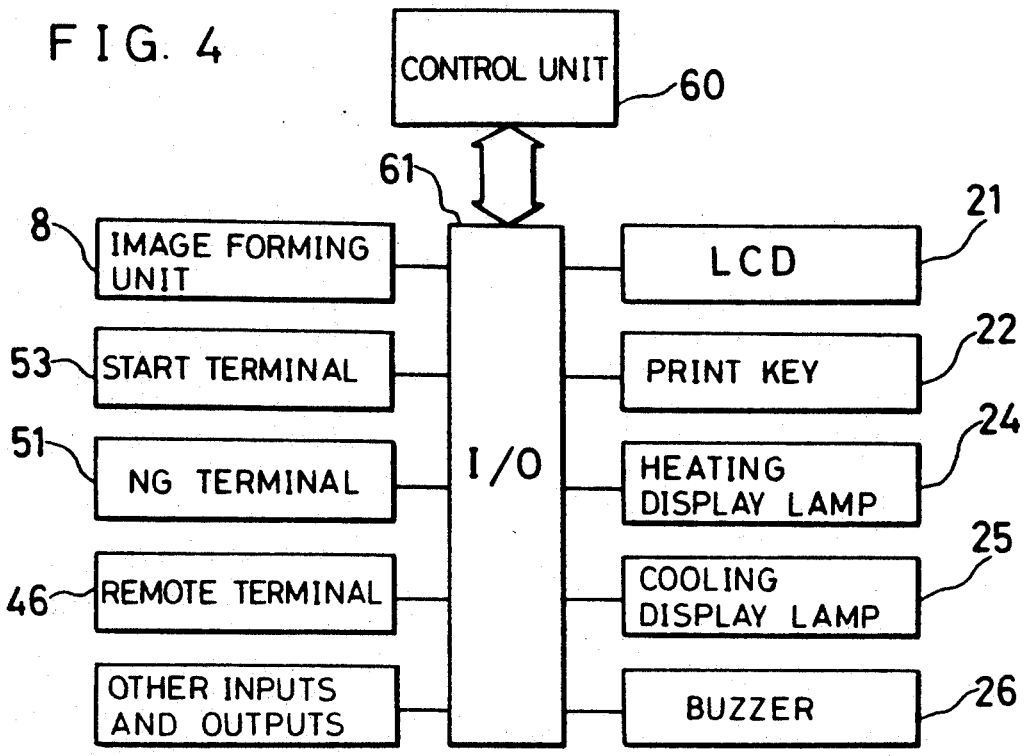
FIG. 4 is a schematic block diagram of a control unit of the apparatus.

A control unit 60 as shown in FIG. 4 is provided in the copying machine according to the present embodiment. The control unit 60 includes a microcomputer consisting of a CPU, a ROM, a RAM and other related devices. The control unit 60 contains an I/O port 61 connected with the image forming unit 8, the liquid crystal display 21, the print key 22, the heating-state lamp 24, the cooling-state lamp 25 and with miscellaneous inputs and outputs. Further connected with the I/O port 61 are the remote terminal 46, the NG terminal 51 and the start terminal 53 of the control circuit 35 to the binding unit 30, and a buzzer 26 which is activated in response to the detection of a malfunction.

Figure 7:
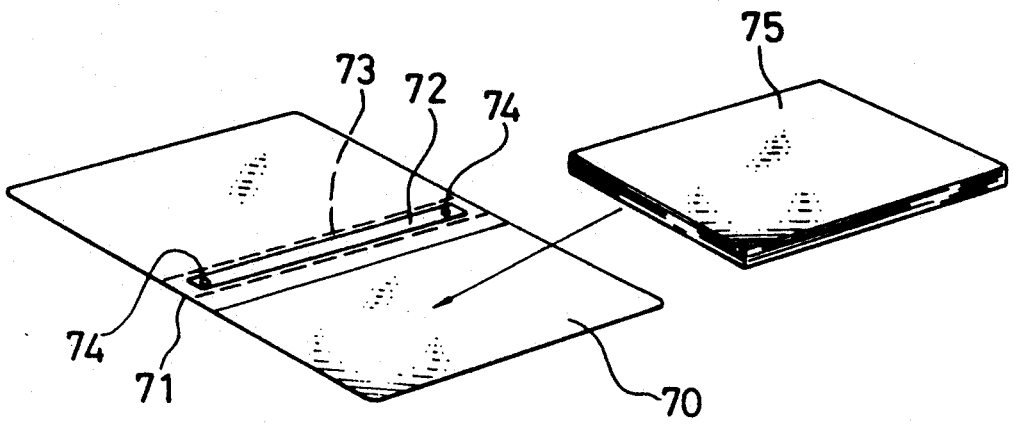
FIGS. 7 and 8 are perspective views of a binder cover.

A binder cover 70 as shown in FIG. 7 is used in the binding operation of this embodiment. The binder cover 70 includes an electric heater 72 and an adhesive layer 73 on the inner surface of its spine 71. The adhesive layer 73 consists, for example, of thermoplastic resin. Electrodes 74 of a pair are disposed on either end of the electric heater 72. The electrodes 74 are exposed in the outer surface (lower surface in the figure) of the spine 71.

Figure 6A:
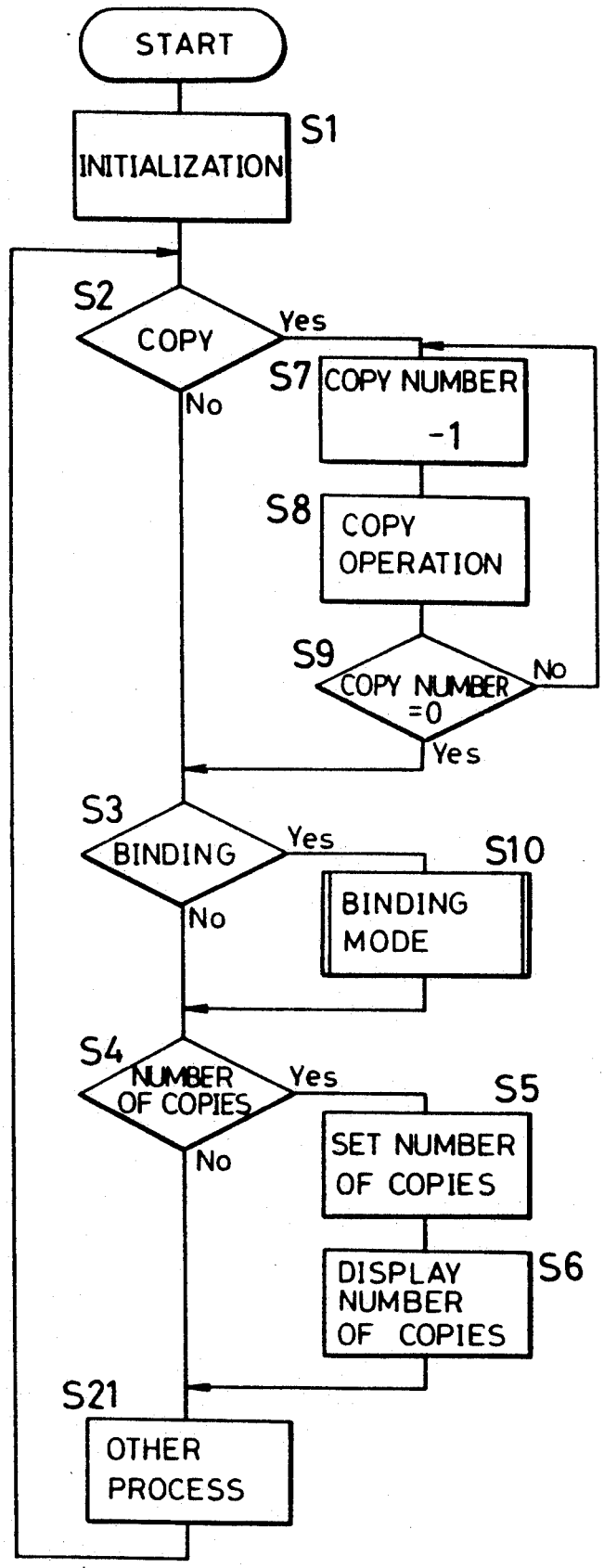
FIGS. 6A and 6B are control process flow charts.
Figure 6B:
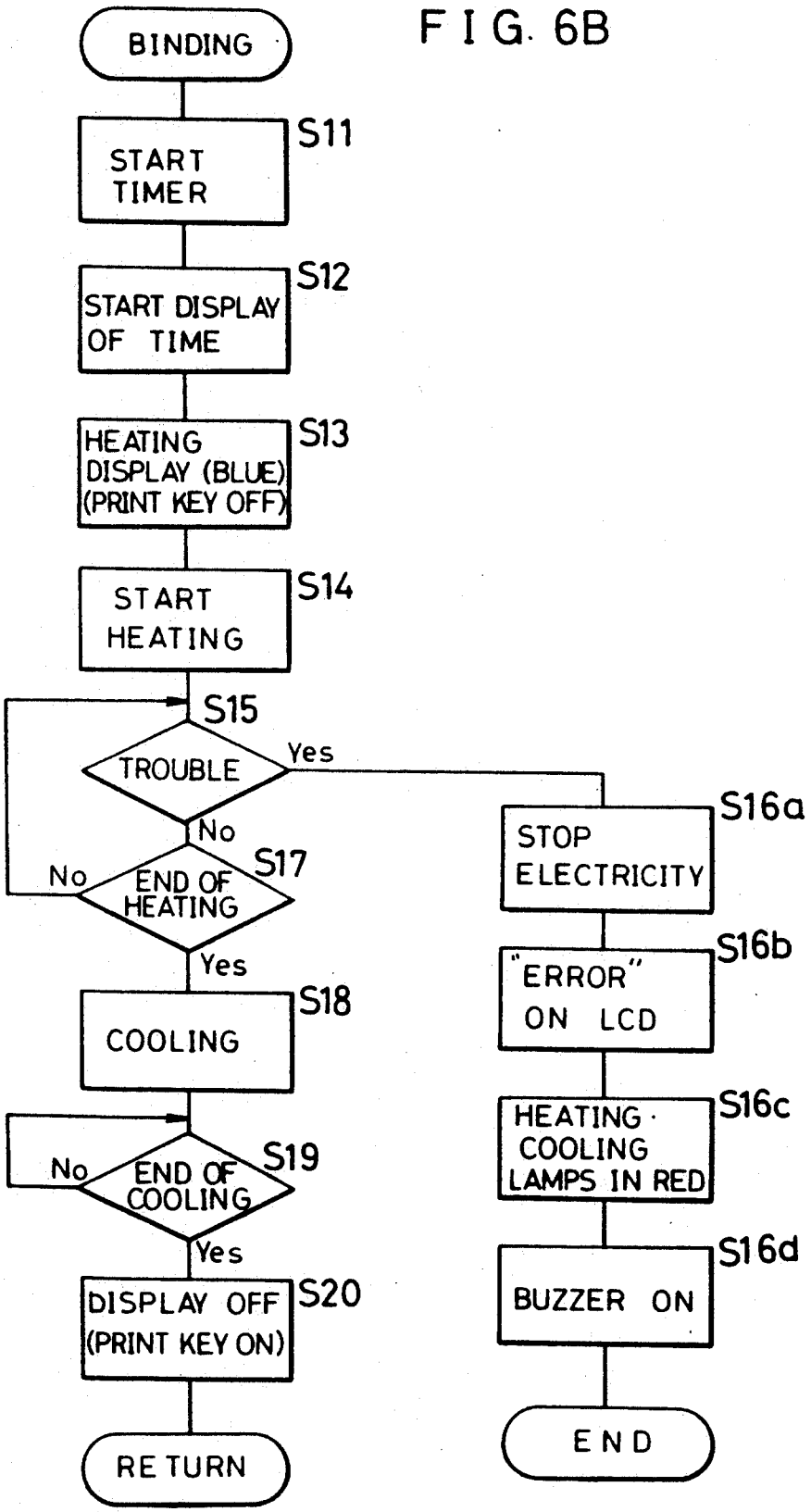

The operation of this embodiment is as described in the following, with reference to FIGS. 6A and 6B showing the control process flow charts.

When the process starts, at step S1, an initialization procedure is carried out wherein, for example, a prescribed temperature for the fixing unit 17 is set. When copy operation has been enabled by the initialization procedure, the LED of the print key 22 is activated. The program then determines at step S2 whether the operator has commanded a copying operation by pressing the print key 22. If no command has been received, the program proceeds to step S3 and determines whether the copying machine is in its binding mode by reference to a signal from the start terminal 53. If the copying machine is not in the binding mode, the program proceeds to step S4. At step S4, it is determined whether the ten-key board 23 has been pressed to designate a given number of copies. Then, other processes of the copying machine are performed at step S21, and the program returns to step S2.

If a number of copies has been designated through the ten-key board 23, the program proceeds from step S4 to step S5 and stores the input numerical value as the number of copies. At step S6, the number of copies is displayed on the liquid crystal display 21. Then the program returns to the main routine.

If the print key 22 is pressed, the program proceeds from step S2 to step S7. At step S7, "1" is subtracted from the copy number and the value obtained by the subtraction is indicated on the liquid crystal display 21. At step S8, the copying operation starts.

In the copy operation, an original sheet on the original support 2 is scanned by the optical scanning system 7, and image information thus obtained through the scan is supplied to the image forming unit 8, so that an image is transferred onto a sheet transported from the feed tray 4 or feed cassette 5. The sheet having the transferred image is fixed by the fixing unit 17 and then it is discharged onto the copy tray 6. After the sequence of operations of a copying process, it is determined at step S9 whether the subtracted copy number is "0" or not. If it is not zero, steps S7 and S8 are executed again in order to continue the copying process. If the determination at step S9 is "Yes", the program returns to the main routine of the control process.

Figure 8:
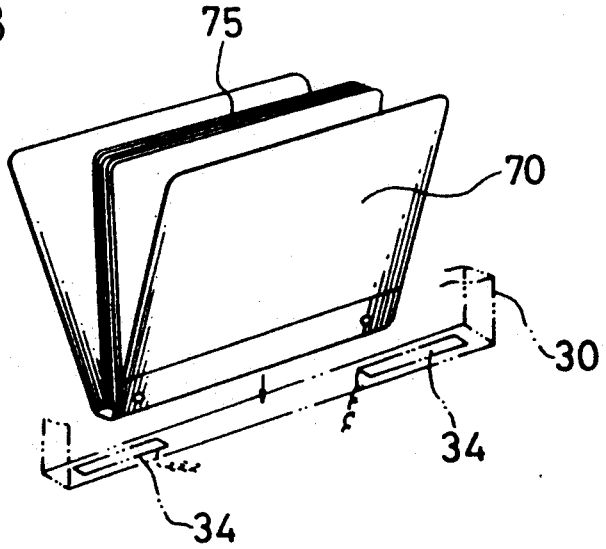
Figure 9:
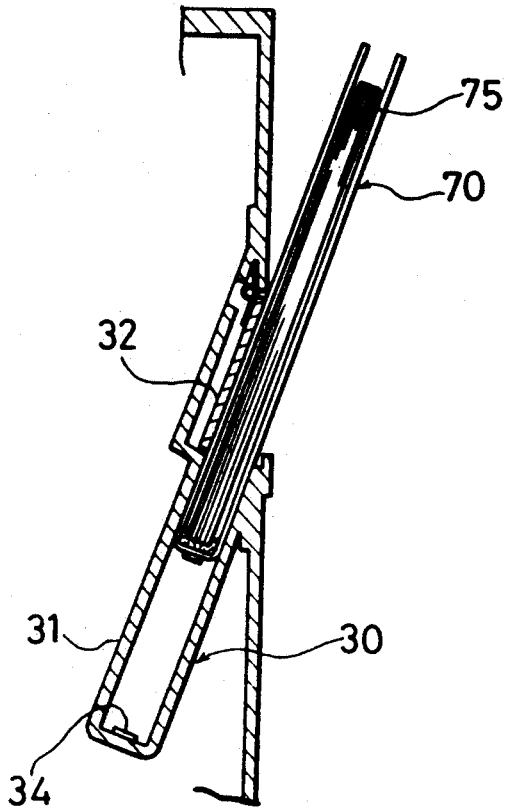
FIGS. 9, 10 and 11 are partly in sectional views of the binding unit in operation.
Figure 10:
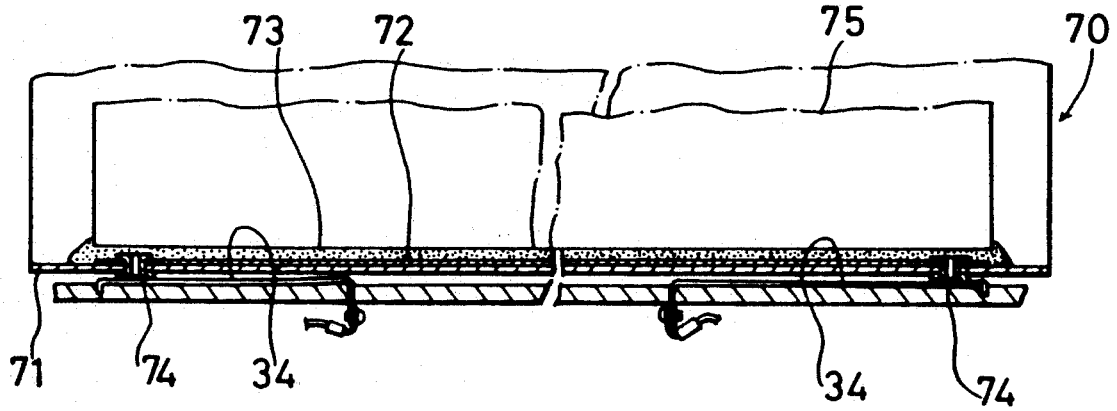
Figure 11:
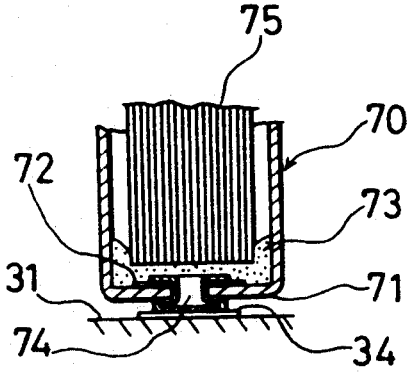

In order to bind a stack of sheets 75 received through the copying process, the sheets 75 are placed in a binder cover 70 and the binder cover 70 is folded, as shown in FIGS. 7 and 8, wherein one side of the stack of sheets 75 makes contact with the adhesive material 73 on the spine 71. The binder cover 70 is then loaded into the container 31, pressing against the cover 32 as shown in FIG. 9. When the binder cover 70 reaches the bottom of the container 31 as shown in FIGS. 10 and 11, the pair of electrodes 34 are brought into electrical connection with the electric heater 72 of the binder 70 through the electrodes 74.

The start terminal 53 generates a high output when the pair of electrodes 34 comes into contact with the electrodes 74, since the potential at the non-inverting terminal of the comparator 52 of the start detecting circuit 48 increases. As a result, the program in the control unit 60 (shown in FIG. 4) proceeds from step S3 to step S10 (FIG. 6A), executing a binding mode subroutine.

In the binding mode subroutine, shown in FIG. 6B, a timer starts at step S11. At step S12, the liquid crystal display 21 is activated, indicating the time remaining for the binding operation. Thus the operator can readily know how much longer it will take to complete the binding at any given time. At step S13, the blue element of the heating-state lamp 24 is illuminated. At the same time, the print key 22 is deactivated. As a result, the operator finds that while the binding unit 30 is engaged in the heating operation, the copying machine will not perform a copying operation. At step S14, the remote terminal 46 of the binding unit 30 generates a high input, whereby the power transistor 43 switches on allowing electric current to flow between the electrodes 34. Consequently, the electric heater 72 of the binder cover 70 heats, melting the adhesive layer 73 which thus adheres the side of the stack of sheets 75 to the binder cover 70.

The power supplied to the electric heater 72 is regulated by the feedback circuit which includes the resistor 45*a* to the comparator 45. If any abnormality, such as an irregular resistance value of the electric heater 72 or a defective contact between the binder cover 70 and the electrodes 34 exists, the malfunction detecting circuit 47 will detect it. More specifically, when the collector potential of the power transistor 43 is outside the normal range defined by the comparator pair 49 and 50, the output from the NG terminal 51 drops. The change of output at the NG terminal 51 is detected at step S15 and FIG. 6B.

If an abnormality is detected, the program then proceeds from step S15 to step S16*a*. At step S16*a*, a low output is induced in the remote terminal 46, thereby cutting off the power to the binding unit 30. At step S16*b*, "ERROR" is shown on the liquid crystal display 21. At step S16*c*, both the heating display lamp 24 and the cooling display lamp 25 illuminate in red. At step S16*d*, the buzzer 26 is activated. These operations at steps S16*b* to S16*d*, readily and reliably alert the operator to the malfunction in the binding unit 30. After the execution of step S16*d*, the program ends. With the program thus terminated, operation of the copying machine cannot be restarted without resetting the program.

If no abnormality is detected by the malfunction detecting circuit 47 during the heating process begun at step S14 of FIG. 6B, the program proceeds from step S15 to step S17. At step S17, it is determined whether a predetermined interval required for the heating process has elapsed by reference to the time measured by the timer activated at step S11. If the interval has not elapsed, the program returns to step S15. If the predetermined heating interval time has elapsed, the program proceeds from step S17 to step S18, executing a cooling process. This process cuts off the power supply to the electrodes 34, switches off the heating-state lamp 24, and switches on the blue element of cooling-state lamp 25. Thus the process clearly apprises the operator that the binding unit 30 has been brought into a cooling state.

At step S19, the program pauses until the predetermined cooling time has elapsed. When the predetermined cooling time has elapsed, the program proceeds to step S20, turning off the time display on the liquid crystal display 21 and turning off the cooling-state lamp 25. In consequence, the liquid crystal display 21 returns to displaying the copy number, and the print key 22 is illuminated. After the process of step S20, the program returns to the main routine shown in FIG. 6A.

If the binder cover 70 is to be cooled down outside the machine, it may be withdrawn from the binding unit 30 after the illumination of the cooling-state lamp 25 at step S15 of FIG. 6B. In this case, a successive binding operation may be started utilizing another binder cover 70, whereby binding operations can be performed in succession for a large number of binder covers 70, at short intervals between the heating processes. In this case, a reset button, not shown, must be pressed to restart the program, whereby the program is then forced to return to the main routine of FIG. 6A.

Figure 6C:
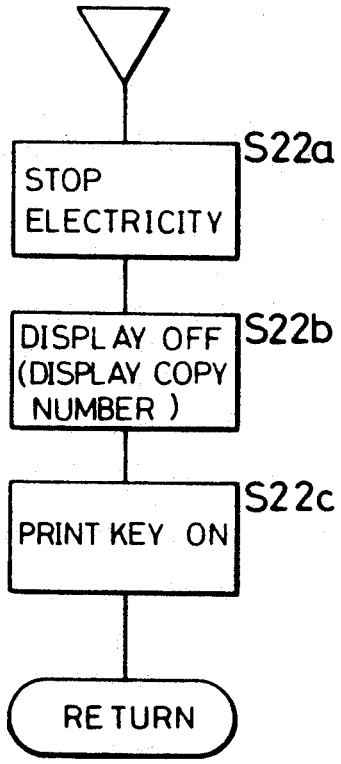
FIG. 6C is a control flow chart of a modification.

Modifications a) A binding mode key may be provided on the operation panel 20 so that the binding operation of the binding unit 30 may be manually started. In this case, the start detecting circuit 48 shown in FIG. 5 is not required.

b) The binding operation time may be displayed with a division of the length of time into two parts, namely, the lengths of remaining heating time and cooling time. Moreover, the binding time may be displayed, for example, by a succession of LEDs, rather than by the liquid crystal display 21. The succession of LEDs displays the remaining time by a corresponding change in the number of LEDs illuminated. The LEDs of the succession are capable of indicating malfunction by changing their color.

c) In place of steps S16*a* to S16*d* of FIG. 6B, a control procedure as shown in FIG. 6C may be provided. Referring to FIG. 6C, at step S22*a*, the same power cutoff process as that of step S16*a* (in FIG. 6B) is performed. At step S22*b*, the heating-state lamp 24 switches off, and the copy number, in place of the time, is displayed on the liquid crystal display 21. At step S22*c*, the print key 22 illuminates, and the program returns to the main routine. In this case, copying operation may be performed regardless of any malfunction in binding operation of the binding unit 30.

In the procedure of FIG. 6C, step S22*b* may be replaced by step S16*c* so that the operator would be informed when trouble occurs in the binding unit 30.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An image forming apparatus having a binding function, comprising:

means for forming an image onto a sheet;

electric heat binding means for binding sheets by heat, provided adjacent to said image forming means;

means for detecting a malfunction in the operation of said binding means; and malfunction indicating means for indicating a malfunction in response to a malfunction detection by said malfunction detecting means, said malfunction indicating means including a binding condition indicator, wherein said binding condition indicator includes a heating indicator for indicating a heating state of said binding means, and a cooling indicator for indicating a cooling state thereof.

2. An apparatus according to claim 1, wherein said heating indicator and said cooling indicator are each capable of illuminating in both blue and red.

3. An apparatus according to claim 1, wherein said malfunction indicating means includes an alphanumeric display of said image forming means.

4. An apparatus according to claim 1, further comprising a shutoff means for interrupting the operation of said binding means in response to the detection of the malfunction by said malfunction detecting means.

5. An apparatus according to claim 4, wherein said shutoff means also interrupts the image forming operation of said image forming means in response to the detection of the malfunction by said malfunction detecting means.

6. An image forming apparatus having a binding function, comprising:

means for forming an image onto a sheet;

means for binding sheets, provided adjacent to said image forming means;

means for detecting malfunction in the operation of said binding means, including a pair of comparators for defining a normal range of a binding operation by values of input voltages at input terminals of the comparators; and means for indicating a malfunction in response to a malfunction detection by said malfunction detecting means.

7. An apparatus according to claim 6, wherein said malfunction detecting means detects malfunction in resistance value or electrode contact of said binding means.

8. An image forming apparatus having a binding function, comprising:

means for forming an image onto a sheet;

means for binding sheets, provided adjacent to said image forming means;

means for detecting malfunction in the operation of said binding means;

means for indicating a malfunction in response to a malfunction detection by said malfunction detecting means; and means for controlling said binding means including a start detection circuit for detecting the start of a binding process.

9. An apparatus according to claim 8, wherein said binding-start detection circuit includes a comparator for detecting the start of a binding process by said binding means.

10. An apparatus according to claim 8, wherein said binding control means further includes a binding-time measuring means which starts in response to the detection of the start of a binding process by said binding-start detection circuit.

11. An image forming apparatus having a binding function, comprising:

means for forming an image onto a sheet;

means for binding sheets, provided adjacent to said image forming means;

means for detecting malfunction in the operation of said binding means;

means for indicating a malfunction in response to a malfunction detection by said malfunction detecting means; and means for controlling said binding means including a display for displaying the time remaining until the end of a binding operation is reached.

12. An image forming apparatus having a binding function, comprising:

means for forming an image onto a sheet;

electric heat binding means for binding sheets by heat, provided adjacent to said image forming means;

means for detecting a malfunction in the operation of said binding means; and malfunction indicating means for indicating a malfunction in response to a malfunction detection by said malfunction detecting means; and binding control means for controlling said binding means, wherein the control of said binding means by said binding control means provides a heating period and a cooling period during a binding operation.

13. An image forming apparatus having a binding function, comprising:

means for forming an image onto a sheet;

electric heat binding means for binding sheets by heat, provided adjacent to said image forming means, said binding means having a container located in the side portion of said image forming means, said container having an inner bottom surface provided with electrodes for supplying electric power;

means for detecting a malfunction in operation of said binding means; and interrupt means for interrupting operation of said binding means in response to the detection of a malfunction by said malfunction detecting means, wherein said interrupt means interrupts the supply of electric power to said binding means.

14. An apparatus according to claim 13, wherein said interrupt means also interrupts the image forming operation of said image forming means in response to the detection of the malfunction by said malfunction detecting means.

15. An apparatus according to claim 14, wherein said interrupt means terminates a control program, whereby the operation of said apparatus is permitted to restart only through a resetting procedure.

16. An image forming apparatus having a binding function, comprising:

means for forming an image onto a sheet;

electric heat binding means for binding sheets by heat, provided adjacent to said image forming means;

means for detecting a malfunction in the operation of said binding means; and malfunction indicating means for indicating a malfunction in response to a malfunction detection by said malfunction detecting means, wherein said binding means has a container located in the side portion of said image forming means, said container being provided with electrodes for supplying electric power.

* * * * *